US011596251B1

(12) United States Patent
Brittain

(10) Patent No.: US 11,596,251 B1
(45) Date of Patent: Mar. 7, 2023

(54) SEASONING SHAKER ASSEMBLY

(71) Applicant: Gerald Brittain, San Angelo, TX (US)

(72) Inventor: Gerald Brittain, San Angelo, TX (US)

( * ) Notice: Subject to any disclaimer, the term of this patent is extended or adjusted under 35 U.S.C. 154(b) by 0 days.

(21) Appl. No.: 17/464,066

(22) Filed: Sep. 1, 2021

(51) Int. Cl.
*B65D 25/00* (2006.01)
*A47G 19/24* (2006.01)
*B65D 83/06* (2006.01)

(52) U.S. Cl.
CPC ..... *A47G 19/24* (2013.01); *B65D 83/06* (2013.01)

(58) Field of Classification Search
CPC ..... A47G 19/24; B65D 83/06
See application file for complete search history.

(56) References Cited

U.S. PATENT DOCUMENTS 2,471,507 A 5/1949 Adams
2,773,628 A * 12/1956 Gabler ..... A47G 19/24 222/457.5
2,974,887 A 3/1961 Grandinetti
3,485,416 A * 12/1969 Fohrman ..... A47G 19/24 D9/503
3,622,329 A 11/1971 Huckstadt
3,964,642 A * 6/1976 Lesh ..... A47G 19/24 222/142.4
4,387,809 A * 6/1983 Botzler ..... A47J 43/27 426/135
4,444,324 A * 4/1984 Grenell ..... B65D 25/04 426/115
5,630,523 A * 5/1997 Wright ..... B65D 21/0231 220/4.27
5,758,801 A * 6/1998 Roling ..... B65D 83/06 222/206
2007/0084863 A1* 4/2007 Mendez ..... B65D 71/502 220/4.27
2008/0173674 A1* 7/2008 Gabler ..... A47G 19/24 222/500
2009/0223999 A1* 9/2009 Hill ..... B65D 81/3205 222/129
2011/0048317 A1 3/2011 Hunking
2012/0241513 A1 9/2012 Sharvit

FOREIGN PATENT DOCUMENTS

WO WO2010123581 10/2010

* cited by examiner

*Primary Examiner* — Bob Zadeh

(57) ABSTRACT

A seasoning shaker assembly for storing a dispensing a variety of food seasonings includes a cylinder that has a pair of chambers to contain a food seasoning. A first closure is removably attached to the cylinder and the first closure has a foraminous surface to dispense the food seasoning positioned in the respective chamber. A second closure is removably attached to the cylinder and the second closure has a foraminous surface to dispense the food seasoning positioned in the respective chamber.

6 Claims, 6 Drawing Sheets

SEASONING SHAKER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to seasoning devices and more particularly pertains to a new seasoning device for storing a dispensing a variety of food seasonings. The device includes a cylinder with a pair of chambers each integrated into the cylinder. Each of the chambers can store a respective type of food seasoning. The device includes a pair of closures that is each coupled to opposite ends of the cylinder. Each of the closures has a foraminous surface for dispensing the food seasonings.

(2) Description of Related Art Including Information Disclosed Under 37 CFR 1.97 and 1.98

The prior art relates to seasoning devices including a salt shaker which includes a chamber for storing salt and a closure for a foraminous surface for dispensing the salt. The prior art discloses a variety of salt shaker and pepper mills which each includes a grinding mechanism for grinding pepper corns. The prior art discloses a portable seasoning replenishment system for filling a seasoning receptacle with a powdered food seasoning.

BRIEF SUMMARY OF THE INVENTION

An embodiment of the disclosure meets the needs presented above by generally comprising a cylinder that has a pair of chambers to contain a food seasoning. A first closure is removably attached to the cylinder and the first closure has a foraminous surface to dispense the food seasoning positioned in the respective chamber. A second closure is removably attached to the cylinder and the second closure has a foraminous surface to dispense the food seasoning positioned in the respective chamber.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
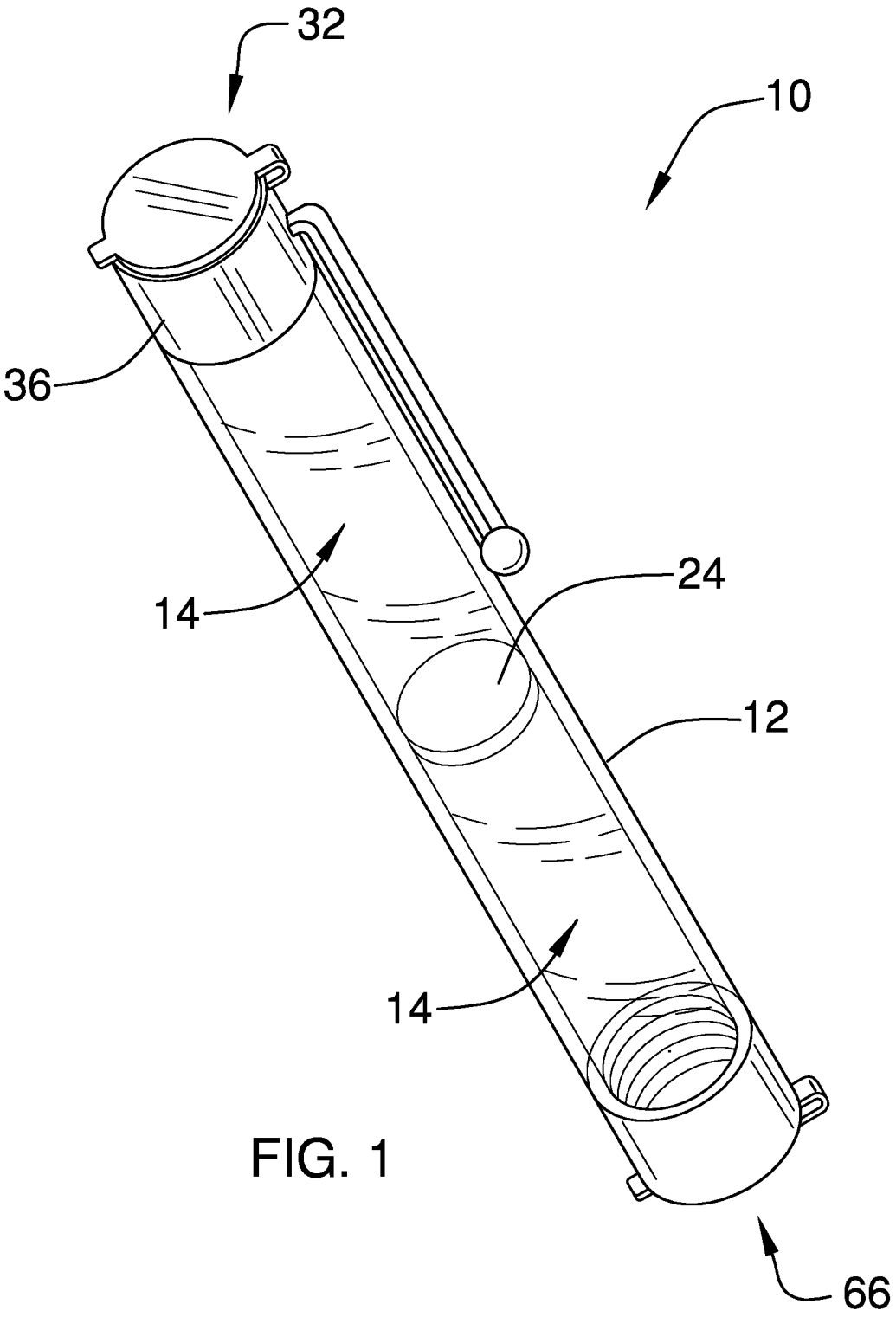
FIG. 1 is a perspective view of a seasoning shaker assembly according to an embodiment of the disclosure.
Figure 2:
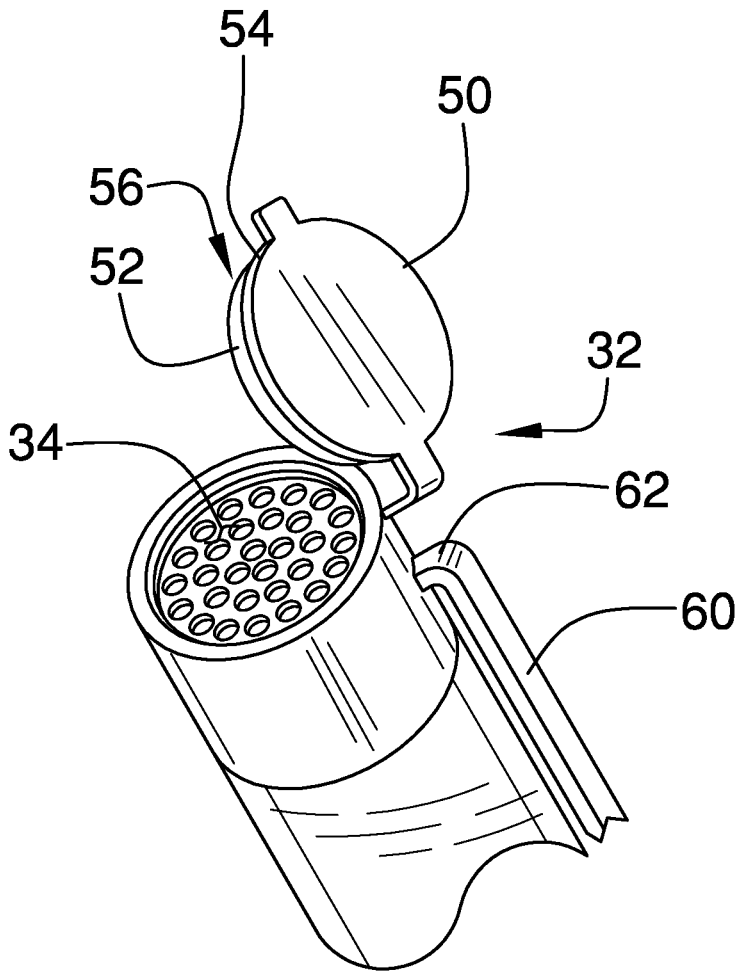
FIG. 2 is a top perspective view of an embodiment of the disclosure.
Figure 3:
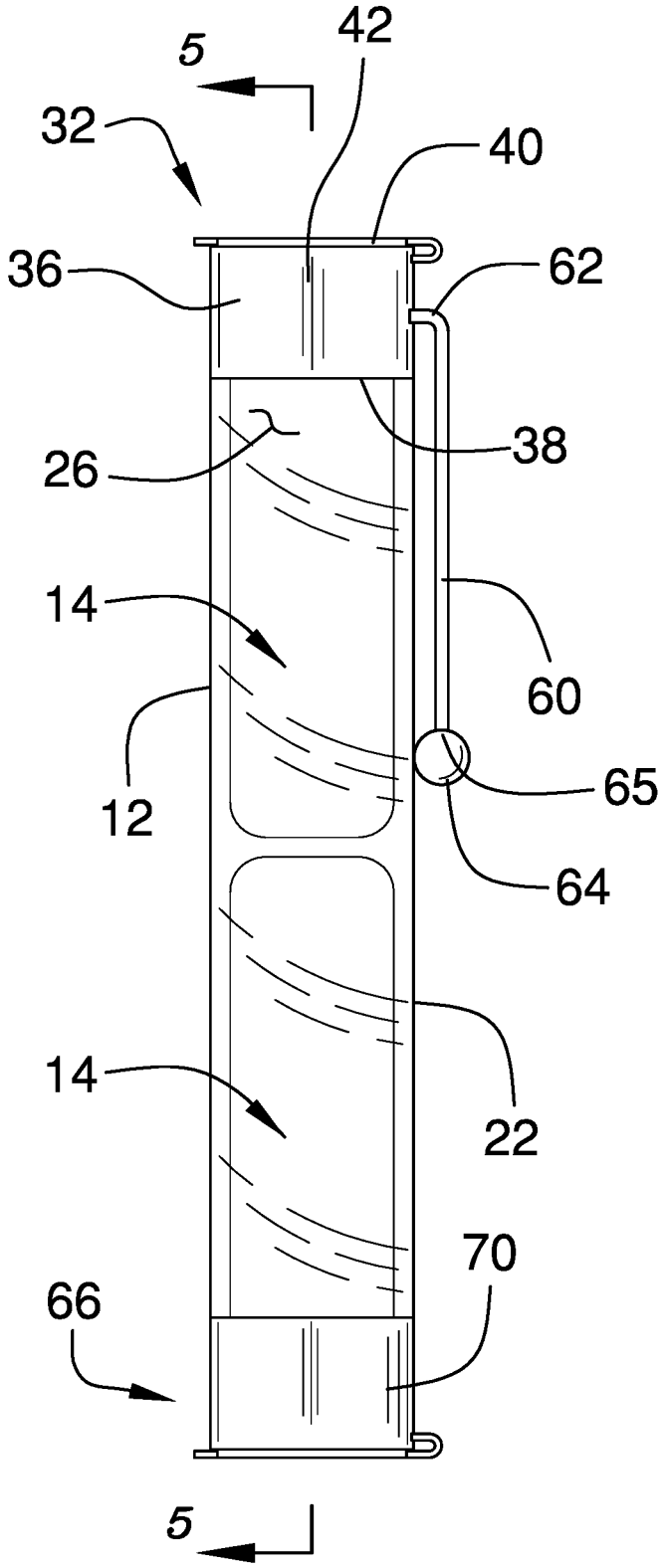
FIG. 3 is a left side view of an embodiment of the disclosure.
Figure 4:
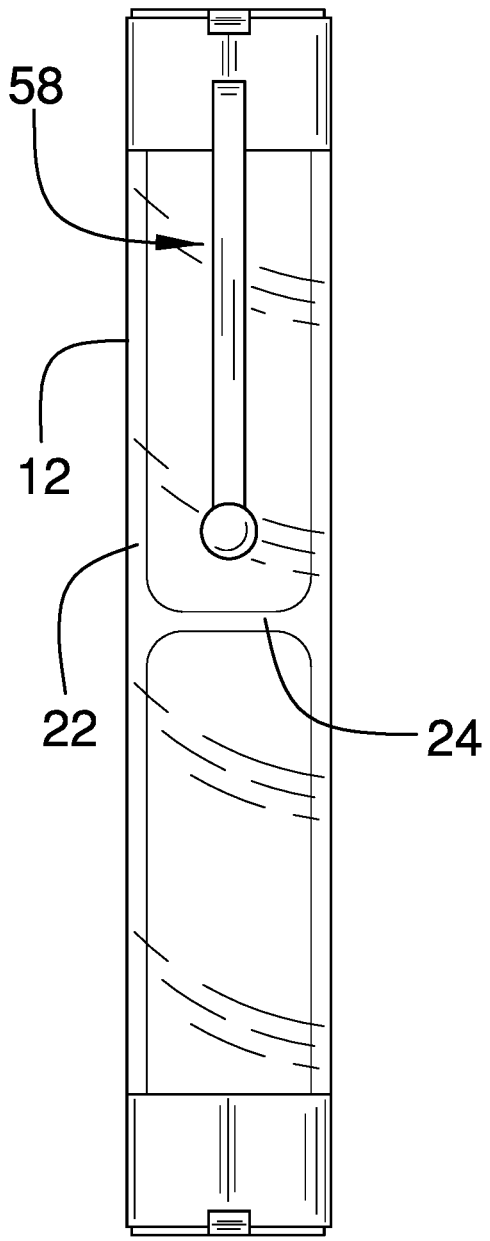
FIG. 4 is a back view of an embodiment of the disclosure.
Figure 5:
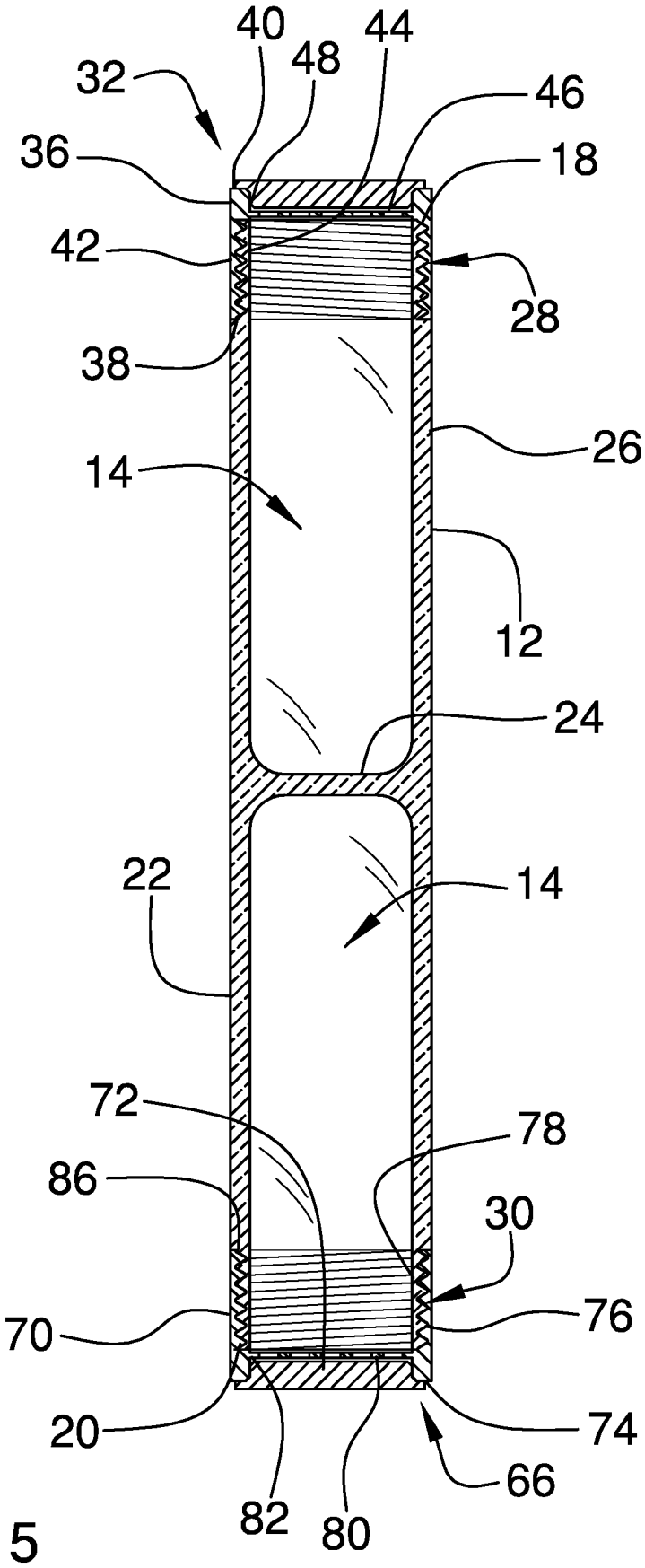
FIG. 5 is a cross sectional view taken along line 5-5 of FIG. 3 of an embodiment of the disclosure.
Figure 6:
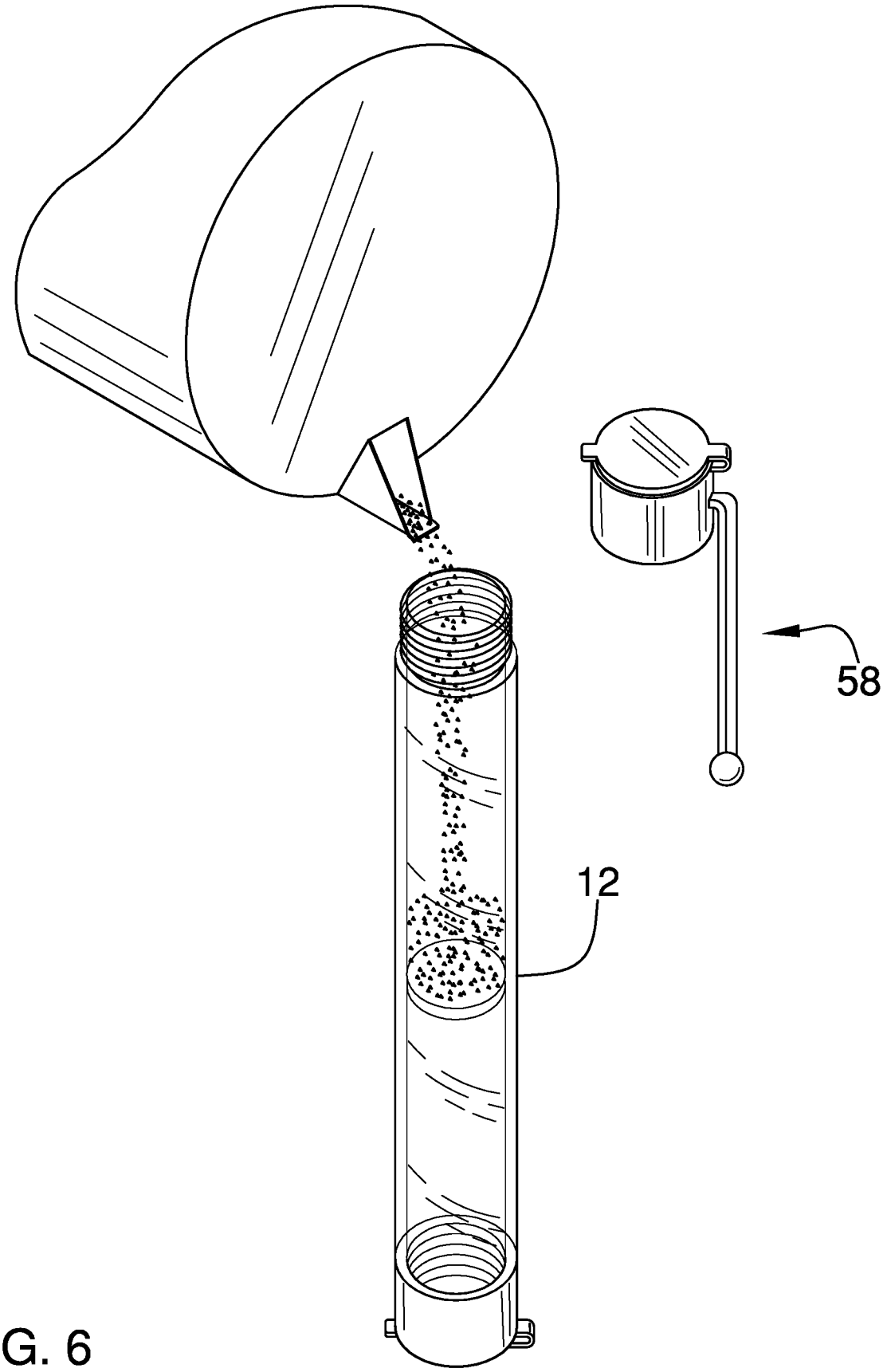
FIG. 6 is a perspective in-use view of an embodiment of the disclosure showing a cylinder being filled with a food seasoning.
Figure 7:
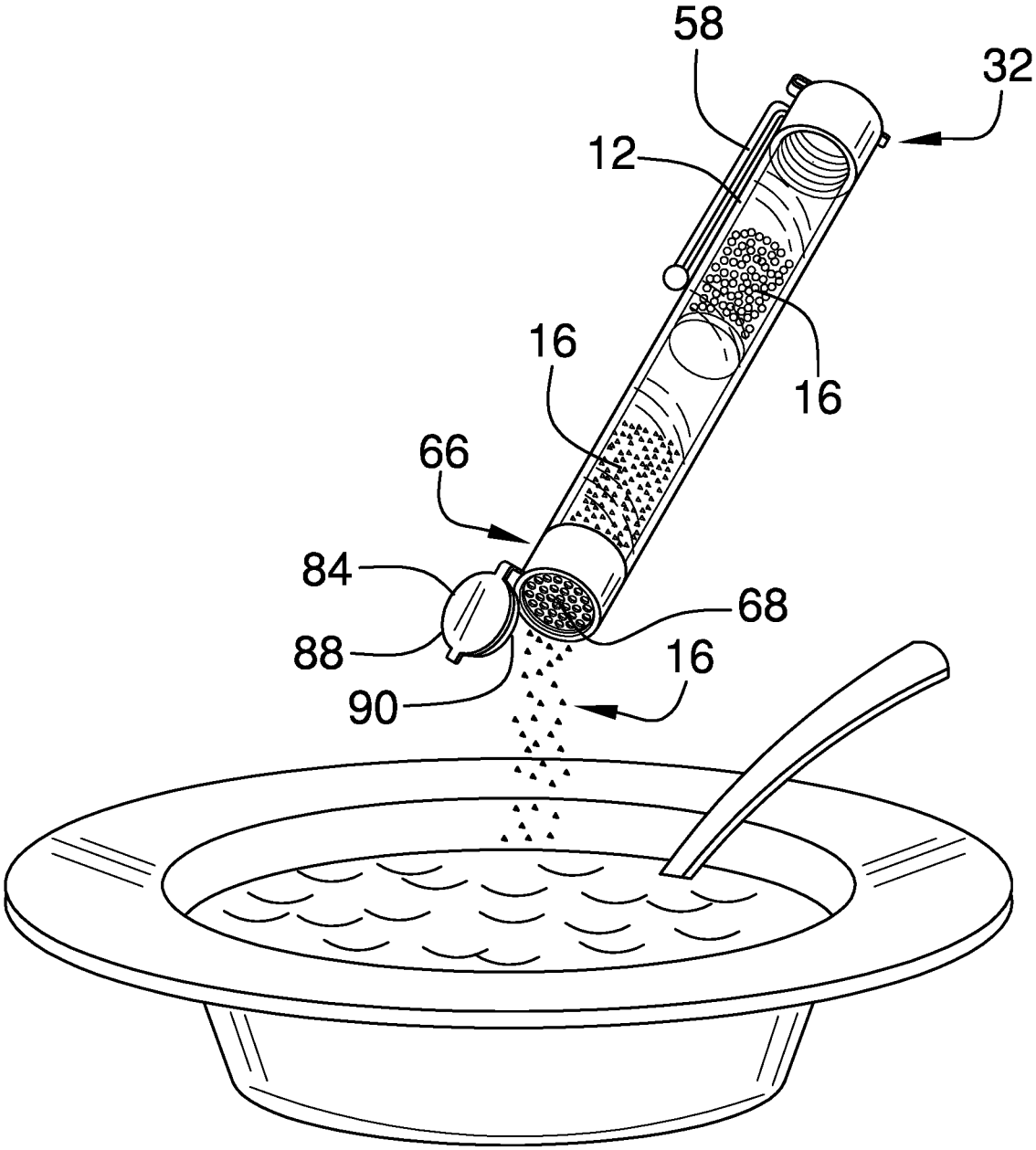
FIG. 7 is a perspective in-use view of an embodiment of the disclosure showing food seasoning being dispensed from a cylinder.

With reference now to the drawings, and in particular to FIGS. 1 through 7 thereof, a new seasoning device embodying the principles and concepts of an embodiment of the disclosure and generally designated by the reference numeral 10 will be described.

As best illustrated in FIGS. 1 through 7, the seasoning shaker assembly 10 generally comprises a cylinder 12 that has a pair of chambers 14 that is each fluidly discrete from each other. Each of the chambers 14 can contain a food seasoning 16, including but not being limited to, salt, pepper, basil, oregano or other herbs or spices commonly employed on food. The cylinder 12 has a first end 18, a second end 20 and an outer wall 22 extending therebetween. The cylinder 12 is hollow and each of the first end 18 and the second end 20 is open into an interior of the cylinder 12.

The cylinder 12 has a divider 24 that is positioned within the cylinder 12. The divider 24 is centrally positioned between the first end 18 and the second end 20 such that the divider 24 defines each of the chambers 14. The outer wall 22 has an outer surface 26 and the outer surface 26 has a first threaded portion 28 that is positioned adjacent to the first end 18. Furthermore, the outer surface 26 has a second threaded portion 30 that is positioned adjacent to the second end 20. The cylinder 12 may be comprised of a translucent material thereby facilitating the food seasoning 16 to be visible in the cylinder 12. Additionally, the cylinder 12 may have a length ranging between approximately 5.0 inches and 7.0 inches and a diameter ranging between approximately 0.5 inches and 1.0 inches.

A first closure 32 is removably attached to the cylinder 12 such that the first closure 32 closes a respective one of the chambers 14. The first closure 32 has a foraminous surface 34 to dispense the food seasoning 16 positioned in the respective chamber. The first closure 32 comprises a first cap 36 that has a primary end 38, a secondary end 40 and an outside wall 42 extending between the primary end 38 and the secondary end 40. The outside wall 42 has an inner surface 44 and the inner surface 44 is threaded adjacent to the primary end 38. Additionally, the inner surface 44 threadably engages the first threaded portion 28 of the outer wall 22 of the cylinder 12.

The first closure 32 includes a first disk 46 that has an outer edge 48 and the first disk 46 is positioned in the first cap 36 such that the outer edge 48 of the first disk 46 is bonded to the inner surface 44 of the outside wall 42. The first disk 46 is foraminous such that the first disk 46 defines the foraminous surface 34 of the first closure 32. Additionally, the first disk 46 is spaced from the secondary end 40 of the first cap 36. The first closure 32 includes a first lid 50 that has a first surface 52 and an outer edge 54. The outer edge 54 of the first lid 50 is hingedly coupled to the outside wall 42 of the first cap 36 at a point located adjacent to the secondary end 40 of the first cap 36. Additionally, the outer edge 48 has a recessed portion 56 which accommodates the secondary end 40 of the first cap 36 when the first lid 50 is closed such that the first lid 50 closes the secondary end 40.

The first closure 32 includes an engagement 58 which comprises a leg 60 and a foot 62. The foot 62 is coupled to the outside wall 42 of the first cap 36 such that the leg 60 extends along the outer wall 22 of the cylinder 12 when the first cap 36 is threadably coupled to the cylinder 12. A ball 64 is coupled to a distal end 65 of the leg 60 with respect to the foot 62. The ball 64 abuts the outer wall 22 of the cylinder 12 when the first cap 36 is threadably coupled to the cylinder 12. The ball 64 is urgeable away from the outer wall 22 to facilitate a support to be extended between the leg 60 and the outer wall 22 of the cylinder 12 for suspending the cylinder 12 from the support. The support may be an edge of an article of clothing worn by a user, such as a shirt pocket or the like.

A second closure 66 is removably attached to the cylinder 12 such that the second closure 66 closes a respective one of the chambers 14. The second closure 66 has a foraminous surface 68 to dispense the food seasoning 16 positioned in the respective chamber 14. The second closure 66 comprises a second cap 70 that has a primary end 72, a secondary end 74 and an outside wall 76 extending between the primary end 72 and the secondary end 74 of the second cap 70. The outside wall 76 of the second cap 70 has an inner surface 78 and the inner surface 78 of the outside wall 42 of the second cap 70 is threaded adjacent to the primary end 72 of the second cap 70. The inner surface 78 of the outside wall 76 of the second cap 70 threadably engages the second threaded portion 30 of the outer wall 22 of the cylinder 12.

The second closure 66 includes a second disk 80 that has an outer edge 82 and the second disk 80 is positioned in the second cap 70. The outer edge 82 of the second disk 80 is bonded to the inner surface 78 of the outside wall 76 of the second cap 70. The second disk 80 is foraminous such that the second disk 80 defines the foraminous surface 68 of the second closure 66. Additionally, the second disk 80 is spaced from the secondary end 74 of the second cap 70.

The second closure 66 includes a second lid 84 that has a first surface 86 and an outer edge 88. The outer edge 88 of the second lid 84 is hingedly coupled to the outside wall 76 of the second cap 70 at a point located adjacent to the secondary end 74 of the second cap 70. The outer edge 88 of the second lid 84 has a recessed portion 90 which accommodates the secondary end 74 of the second cap 70 when the second lid 84 is closed such that the second lid 84 closes the secondary end 74 of the second cap 70.

In use, the chosen food seasonings 16 are each poured into the respective chambers 14 in the cylinder 12 and each of the first closure 32 and the second closure 66 are threaded onto the cylinder 12. In this way the food seasonings 16 can be dispensed through the foraminous surfaces 34, 68 of the first closure 32 and the second closure 66. Moreover, cylinder 12 can be carried when eating at a restaurant, for example, or other location away from home. In this way food that is being eaten can be seasoned according a user's preferences regardless of where the food is being eaten.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A seasoning shaker assembly for containing and dispensing different seasonings discretely from each other, said assembly comprising:

a cylinder having a pair of chambers each being fluidly discrete from each other wherein each of said chambers is configured to contain a food seasoning;

a first closure being removably attached to said cylinder such that said first closure closes a a first chamber of said pair of chambers, said first closure having a foraminous surface wherein said foraminous surface is configured to dispense the food seasoning positioned in said respective chamber; and a second closure being removably attached to said cylinder such that said second closure closes a second chamber of said pair of chambers, said second closure having a foraminous surface wherein said foraminous surface of said second closure is configured to dispense the food seasoning positioned in said respective chamber;

wherein said cylinder has a first end, a second end and an outer wall extending therebetween, said cylinder being hollow, each of said first end and said second end being open into an interior of said cylinder, said cylinder having a divider being positioned within said cylinder, said divider being centrally positioned between said first end and said second end such that said divider defines each of said chambers, said outer wall having an outer surface, said outer surface having a first threaded portion being positioned adjacent to said first end, said outer surface having a second threaded portion being positioned adjacent to said second end;

wherein said first closure comprises a first cap, a first disk and a first lid; and said second closure comprises:

a second cap having a primary end, a secondary end and an outside wall extending between said primary end and said secondary end of said second cap, said outside wall of said second cap having an inner surface, said inner surface of said outside wall of said second cap being threaded adjacent to said primary end of said second cap, said inner surface of said outside wall of said second cap threadably engaging said second threaded portion of said outer wall of said cylinder; and a second disk having an outer edge, the second disk being positioned in said second cap having said outer edge of said second disk being bonded to said inner surface of said outside wall of said second cap, said second disk being foraminous such that said second disk defines said foraminous surface of said second closure, said second disk being spaced from said secondary end of said second cap.

2. The assembly according to claim 1, wherein said first cap having a primary end, a secondary end and an outside wall extending between said primary end and said secondary end, said outside wall having an inner surface, said inner surface being threaded adjacent to said primary end, said inner surface threadably engaging said first threaded portion of said outer wall of said cylinder, and the first disk having an outer edge, the first disk being positioned in said first cap having said outer edge of said first disk being bonded to said inner surface of said outside wall, said first disk being foraminous such that said first disk defines said foraminous surface of said first closure, said first disk being spaced from said secondary end of said first cap.

3. The assembly according to claim 1, wherein said second closure comprises a second lid having a first surface and an outer edge, said outer edge of said second lid being hingedly coupled to said outside wall of said second cap at a point located adjacent to said secondary end of said second cap, said outer edge of said second lid having a recessed portion which accommodates said secondary end of said second cap when said second lid is closed such that said second lid closes said secondary end of said second cap.

4. The assembly according to claim 1, further comprising:

said first closure comprising:

said first cap having a primary end, a secondary end and an outside wall extending between said primary end and said secondary end, said outside wall having an inner surface, said inner surface being threaded adjacent to said primary end, said inner surface threadably engaging said first threaded portion of said outer wall of said cylinder;

said first disk having an outer edge, the first disk being positioned in said first cap having said outer edge of said first disk being bonded to said inner surface of said outside wall, said first disk being foraminous such that said first disk defines said foraminous surface of said first closure, said first disk being spaced from said secondary end of said first cap;

said first lid having a first surface and an outer edge, said outer edge of said first lid being hingedly coupled to said outside wall of said first cap at a point located adjacent to said secondary end of said first cap, said outer edge of said first lid having a recessed portion which accommodates said secondary end of said first cap when said first lid is closed such that said first lid closes said secondary end;

an engagement comprising a leg and a foot, said foot being coupled to said outside wall of said first cap such that said leg extends along said outer wall of said cylinder when said first cap is threadably coupled to said cylinder; and a ball being coupled to a distal end of said leg with respect to said foot, said ball abutting said outer wall of said cylinder when said first cap is threadably coupled to said cylinder, said ball being urgeable away from said outer wall wherein said ball is configured to facilitate a support to be extended between said leg and said outer wall of said cylinder for suspending said cylinder from the support; and said second closure comprising a second lid having a first surface and an outer edge, said outer edge of said second lid being hingedly coupled to said outside wall of said second cap at a point located adjacent to said secondary end of said second cap, said outer edge of said second lid having a recessed portion which accommodates said secondary end of said second cap when said second lid is closed such that said second lid closes said secondary end of said second cap.

5. A seasoning shaker assembly for containing and dispensing different seasonings discretely from each other, said assembly comprising:

a cylinder having a pair of chambers each being fluidly discrete from each other wherein each of said chambers is configured to contain a food seasoning;

a first closure being removably attached to said cylinder such that said first closure closes a a first chamber of said pair of chambers, said first closure having a foraminous surface wherein said foraminous surface is configured to dispense the food seasoning positioned in said respective chamber;

a second closure being removably attached to said cylinder such that said second closure closes a second chamber of said pair of chambers, said second closure having a foraminous surface wherein said foraminous surface of said second closure is configured to dispense the food seasoning positioned in said respective chamber;

wherein said cylinder has a first end, a second end and an outer wall extending therebetween, said cylinder being hollow, each of said first end and said second end being open into an interior of said cylinder, said cylinder having a divider being positioned within said cylinder, said divider being centrally positioned between said first end and said second end such that said divider defines each of said chambers, said outer wall having an outer surface, said outer surface having a first threaded portion being positioned adjacent to said first end, said outer surface having a second threaded portion being positioned adjacent to said second end;

wherein said first closure comprises a first cap having a primary end, a secondary end and an outside wall extending between said primary end and said secondary end, said outside wall having an inner surface, said inner surface being threaded adjacent to said primary end, said inner surface threadably engaging said first threaded portion of said outer wall of said cylinder; and a first disk having an outer edge, the first disk being positioned in said first cap having said outer edge of said first disk being bonded to said inner surface of said outside wall, said first disk being foraminous such that said first disk defines said foraminous surface of said first closure, said first disk being spaced from said secondary end of said first cap; and wherein said first closure comprises a first lid having a first surface and an outer edge, said outer edge of said first lid being hingedly coupled to said outside wall of said first cap at a point located adjacent to said secondary end of said first cap, said outer edge of said first lid having a recessed portion which accommodates said secondary end of said first cap when said first lid is closed such that said first lid closes said secondary end.

6. A seasoning shaker assembly for containing and dispensing different seasonings discretely from each other, said assembly comprising:

a cylinder having a pair of chambers each being fluidly discrete from each other wherein each of said chambers is configured to contain a food seasoning;

a first closure being removably attached to said cylinder such that said first closure closes a a first chamber of said pair of chambers, said first closure having a foraminous surface wherein said foraminous surface is configured to dispense the food seasoning positioned in said respective chamber;

a second closure being removably attached to said cylinder such that said second closure closes a second chamber of said pair of chambers, said second closure having a foraminous surface wherein said foraminous surface of said second closure is configured to dispense the food seasoning positioned in said respective chamber;

wherein said cylinder has a first end, a second end and an outer wall extending therebetween, said cylinder being hollow, each of said first end and said second end being open into an interior of said cylinder, said cylinder having a divider being positioned within said cylinder, said divider being centrally positioned between said first end and said second end such that said divider defines each of said chambers, said outer wall having an outer surface, said outer surface having a first threaded portion being positioned adjacent to said first end, said outer surface having a second threaded portion being positioned adjacent to said second end; and wherein said first closure comprises a first cap having a primary end, a secondary end and an outside wall extending between said primary end and said secondary end, said outside wall having an inner surface, said inner surface being threaded adjacent to said primary end, said inner surface threadably engaging said first threaded portion of said outer wall of said cylinder; and a first disk having an outer edge, the first disk being positioned in said first cap having said outer edge of said first disk being bonded to said inner surface of said outside wall, said first disk being foraminous such that said first disk defines said foraminous surface of said first closure, said first disk being spaced from said secondary end of said first cap;

an engagement comprising a leg and a foot, said foot being coupled to said outside wall of said first cap such that said leg extends along said outer wall of said cylinder when said first cap is threadably coupled to said cylinder; and a ball being coupled to a distal end of said leg with respect to said foot, said ball abutting said outer wall of said cylinder when said first cap is threadably coupled to said cylinder, said ball being urgeable away from said outer wall wherein said ball is configured to facilitate a support to be extended between said leg and said outer wall of said cylinder for suspending said cylinder from the support.

* * * * *